United States Patent [19]

Tanguy

[11] Patent Number: 4,479,564

[45] **Date of Patent: * Oct. 30, 1984**

[54] SYSTEM AND METHOD FOR MONITORING DRILL STRING CHARACTERISTICS DURING DRILLING

[75] Inventor: Denis R. Tanguy, Houston, Tex.

[73] Assignee: Schlumberger Technology Corporation, New York, N.Y.

[ * ] Notice: The portion of the term of this patent subsequent to Dec. 1, 1998 has been disclaimed.

[21] Appl. No.: 325,630

[22] Filed: Nov. 30, 1981

Related U.S. Application Data

[63] Continuation-in-part of Ser. No. 029,423, Apr. 12, 1979, Pat. No. 4,303,994.

[51] Int. Cl.[3] ..... G01V 1/40

[52] U.S. Cl. ..... 181/105; 367/35; 175/45; 33/304

[58] Field of Search ..... 367/35, 84; 181/102, 181/105; 166/250, 66; 175/45; 33/304, 313

[56] References Cited

U.S. PATENT DOCUMENTS

| | | | |
|---|---|---|---|
| 2,255,721 | 9/1941 | Rathingly et al. | 367/83 |
| 2,930,137 | 3/1960 | Arps | 175/45 |
| 3,587,176 | 6/1971 | Schnert | 33/313 |
| 3,622,971 | 11/1971 | Arps | 367/83 |
| 3,770,006 | 11/1973 | Sexton et al. | 367/83 |
| 3,820,063 | 6/1974 | Sexton | 367/84 |
| 3,952,473 | 7/1976 | Patton et al. | 367/83 |
| 3,982,431 | 9/1976 | Grosso et al. | 73/151 |
| 3,983,948 | 10/1976 | Jeter | 367/83 |
| 4,013,945 | 3/1977 | Grosso | 324/34 R |
| 4,021,774 | 5/1977 | Asmundsson et al. | 340/18 R |
| 4,100,528 | 7/1978 | Bernard et al. | 367/83 |
| 4,103,281 | 7/1978 | Strom et al. | 340/18 LD |
| 4,167,000 | 9/1979 | Bernard et al. | 367/84 |
| 4,282,468 | 8/1981 | Cerley et al. | 324/371 |

FOREIGN PATENT DOCUMENTS

| | | | |
|---|---|---|---|
| 972556 | 8/1975 | Canada | 33/313 |
| 2049363 | 6/1969 | France | 175/45 |
| 1459668 | 12/1976 | United Kingdom . | |
| 1463738 | 2/1977 | United Kingdom . | |
| 252236 | 9/1967 | U.S.S.R. | 175/45 |

*Primary Examiner*—Nelson Moskowitz

[57] ABSTRACT

A measurement system detects a downhole drilling variable in relation to the rotational orientation of a drill string during drilling. The system includes a downhole reference signal generator and a downhole variable signal generator. The reference signal generator is coupled downhole to the drill string for generating a downhole reference (DR) signal indicative of the angular relationship between the angular orientation of a lower portion of the drill string about its axis and a directional reference, such as gravity or the earth's magnetic field. The downhole variable signal generator detects downhole parameters and generates a downhole variable (DV) signal representative of a downhole parameter of interest during drilling, such as the bending moment applied to the lower portion of the drill string. The phase-coherent DV signal and DR signals are thereupon processed to provide an output signal which indicates the resultant lateral force applied to the drill string at the drill bit during drilling and which is useful in projecting the probable drilling direction.

23 Claims, 8 Drawing Figures

FIG. 2
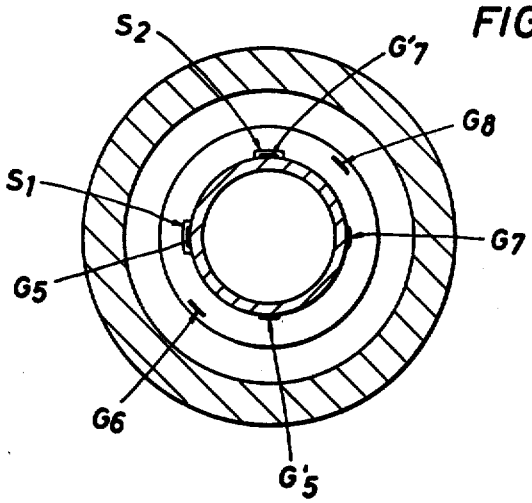
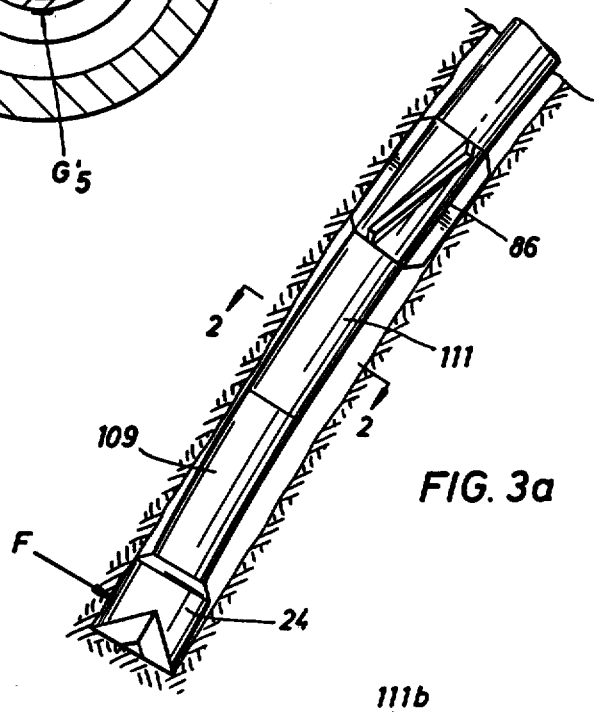
FIG. 3a
FIG. 3b
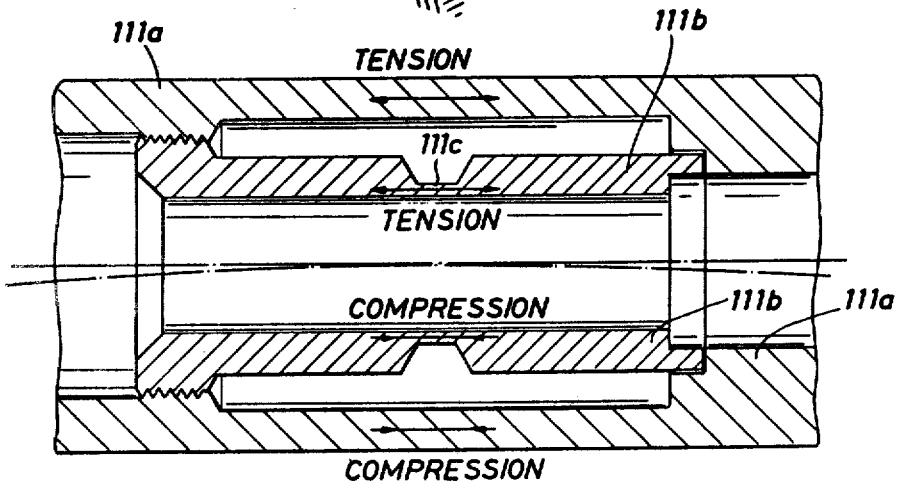

SYSTEM AND METHOD FOR MONITORING DRILL STRING CHARACTERISTICS DURING DRILLING

BACKGROUND OF THE INVENTION

1. Prior Application Data

This application is a continuation-in-part of my prior copending application Ser. No. 029,423, filed Apr. 12, 1979, now U.S. Pat. No. 4,303,994, issued Dec. 1, 1981.

2. Field of the Invention

The present invention relates generally to apparatus and methods for measuring downhole conditions within boreholes and more particularly relates to apparatus and methods for monitoring downhole characteristics of the drill string during drilling.

3. The Prior Art

Various measuring-while-drilling techniques for telemetering data representing downhole conditions during drilling of a well have been suggested. U.S. Pat. Nos. 4,100,528 (Bernard et al.), 4,103,281 (Strom et al.), and 4,167,000 (a continuation of application Ser. No. 727,685, now abandoned), all assigned to the assignee of the present invention and having an effective filing date of Sept. 29, 1976, disclose a measuring-while-drilling system utilizing a phase-shift-keyed modulation system. Logging-while-drilling systems utilizing analog motor control systems in phase-shift-keyed modulation systems are disclosed in U.S. Pat. Nos. 3,309,656 (Godbey); 3,789,355 (Patton); and 3,820,063 (Sexton et al.). The measuring-while-drilling and logging-while-drilling systems referenced therein disclose telemetry systems for monitoring downhole conditions concurrently with the drilling of the borehole.

The referenced measuring-while-drilling patents disclose various downhole conditions which may be monitored. For example, sensors may be provided for monitoring the direction of the hole, weight on bit, temperature conditions, natural gamma radiation, and formation resistivity.

There are other downhole conditions which are significant during the drilling of a borehole. Since boreholes are rarely straight, knowledge of the crookedness of the borehole is important in that excessively crooked boreholes adversely affect rotation of the drill pipe and adversely affect preproduction and production processes, such as the ease of casing placement and the wear of the sucker rods. U.S. Pat. No. 2,930,137, issued Mar. 29, 1960, to Arps suggests one attempt to solve the borehole crookedness problem using a measuring-while-drilling technique which attempts to detect the beginning of a dogleg by detecting bending moments.

The causes of borehole crookedness or deviation have been analyzed and at least in part have been attributed to the relative flexibility of the drill string and drill collars and to the forces acting on the string that cause it to bend. These forces include forces due to drill string mechanics including weight-on-bit and weight-of-the-drill collar, and forces due to interaction of the drill bit and the rock.

The significance of being able to respond to downhole conditions for controlling deviation of the borehole has been recognized. Proposals for controlling borehole deviation and direction have included control of the weight-on-bit parameter, and the control of drill string flexibility, such as control of the drill string diameter and the use and placement of stabilizers. In connection with these proposals computer analysis techniques have been developed for statically characterizing a given drill string for a given earth condition. The computer analysis provides a proposal, for example a particular placement of stabilizers and a particular weight-on-bit for a given drill string structure, which is to controllably introduce a particular bend in the drill string during drilling. The bend is attempted to be induced in the proper direction to effect the desired borehole deviation and direction.

Despite the various proposals and suggestions for controlling borehole deviation, it is believed that there have been no effective ways yet devised for predicting the future course which a drill bit will take during the drilling of a borehole. Techniques which require analysis of the previously drilled borehole are unsatisfactorily slow and burdensome and perhaps unreliable. Techniques which attempt to controllably bend the pipe during drilling are generally unreliable since there is presently no known way to monitor the nature, i.e., the direction and the degree, of the bend which has been induced. Accordingly, it would be highly desirable to provide a system which yields information on downhole drilling of the bit during continued drilling, thereby allowing corrections to be effected to the drilling operations for controlling deviations while the drill string remains in the borehole.

SUMMARY OF THE INVENTION

The present invention overcomes the above indicated shortcomings by providing a method and apparatus for monitoring characteristics of the drill string during drilling. A downhole drilling variable, such as the bending moment applied to a lower portion of the drill string, is detected in relation to the rotational orientation of the drill string which in turn is coordinated with a directional coordinate reference, such as gravity or the earth's magnetic field. The magnitude and direction of the applied bending moment are indicative of the resultant of lateral forces applied to the drill bit, and are useful in projecting the course which the drill bit will take during continued drilling.

The system for monitoring a downhole drilling parameter in relation to the rotational orientation of a drill string during drilling includes a reference signal generator, a downhole variable signal generator, and a signal processor. The reference signal generator is coupled downhole to the drill string for generating a downhole reference (DR) signal indicative of the relationship between the angular rotation of the drill string about its axis and a directional reference. The downhole variable signal generator is coupled downhole to the drill string for generating a downhole variable (DV) signal representing a downhole drilling variable. The signal processor is coupled to receive the DR signal and the DV signal for generating a processed signal representative of the value of the drilling variable as a function of the positional orientation of the drill string.

The signal processor may be implemented uphole, downhole, or partially uphole and partially downhole. Accordingly, the system includes a telemetry system for transferring to a location uphole the signals generated downhole. The type of signal processor, i.e., whether uphole or downhole, or partially uphole or partially downhole, depends in part upon the type of telemetry system employed. For example, the telemetry system may be a wire-line type system which can transmit data at a relatively high rate. Or, an alternative may be a measuring-while-drilling mud telemetry system transmitting at a relatively slower rate. When the relatively slower telemetry system is employed, it is preferred that at least some signal processing be accomplished downhole in order to utilize time which is available prior to transmitting.

According to another aspect of the invention, the downhole drilling parameter which is monitored by the aforementioned system preferably is indicative of lateral forces applied to the drill bit. For this embodiment, one or more reference signal generators is coupled to the lower portion of the drill string for generating a reference signal indicative of the angular relationship between the lower portion of the drill string and a directional reference. A strain signal generator is coupled to the lower portion of the drill string for generating a strain signal which is indicative of the bending moment applied to such lower portion of the drill string, which in turn is indicative of the magnitude of the resultant lateral force applied to the lowermost portion of the drill string, i.e., to the drill bit. Telemetering and processing circuitry is coupled to receive the strain signal and the reference signal for generating a direction signal representative of the direction of the resultant lateral force applied to the bit of the drill string. The telemetering and processing circuitry thereupon provides the direction signal to a location uphole. This system is preferably employed with the drill string of the type which is rotated during drilling of the borehole, but may also be employed with a non-rotating drill string having a downhole drilling motor.

The reference signal generator preferably utilizes either magnetometers or accelerometers such that the directional reference is either the magnetic field of the earth or gravity, respectively. Preferably, the magnetometers or accelerometers are secured to the drill string at radii which are orthogonal to one another.

According to the method of the invention, a reference signal is generated downhole to be indicative of the rotational orientation of a lower portion of the drill string about its axis with respect to a directional reference. A downhole variable signal is generated downhole to represent a downhole drilling variable, such as the resultant bending moment applied to a lower portion of the drill string. In response to the reference signal and to the downhole variable signal, a processed signal is generated to be representative of the value of the drilling variable as a function of the rotational orientation of the drill string.

Preferably, the step of generating the downhole variable signal comprises the step of detecting the resultant bending moment applied to a lower portion of the drill string, which is related to the lateral forces applied to the lowermost portion of the drill string, i.e., to the drill bit. Preferably, the step of detecting the bending moment comprises the step of measuring the amount of stress on the lower portion of the drill string at a location relatively near the drill bit.

The method of the invention also includes the step of telemetering downhole signals to a location uphole. If the step of telemetering includes a system which transmits at relatively slow rates, preferably the step of generating a process signal is at least in part performed downhole. If a telemetry system of a relatively high rate is employed, the step of generating the processed signal may be performed partially downhole or entirely uphole.

It is thus a general object of the present invention to provide a new and improved method and apparatus for monitoring downhole drilling parameters of the lower portion of a drill string during drilling in relation to the orientation of the lower portion of the drill string.

BRIEF DESCRIPTION OF THE DRAWINGS

The above noted and other features and advantages of the present inventon will become more apparent in view of the following description of a preferred embodiment when read in conjunction with the drawings, wherein:

FIG. 2 is a cross sectional view taken along Section 2—2 of the drill string section in FIG. 3*a* and shows the location of various sensors utilized according to the invention;

FIGS. 3*a* and 3*b* are schematic illustrations representing a bent drill string;

DESCRIPTION OF A PREFERRED EMBODIMENT

Figures 1, 6:
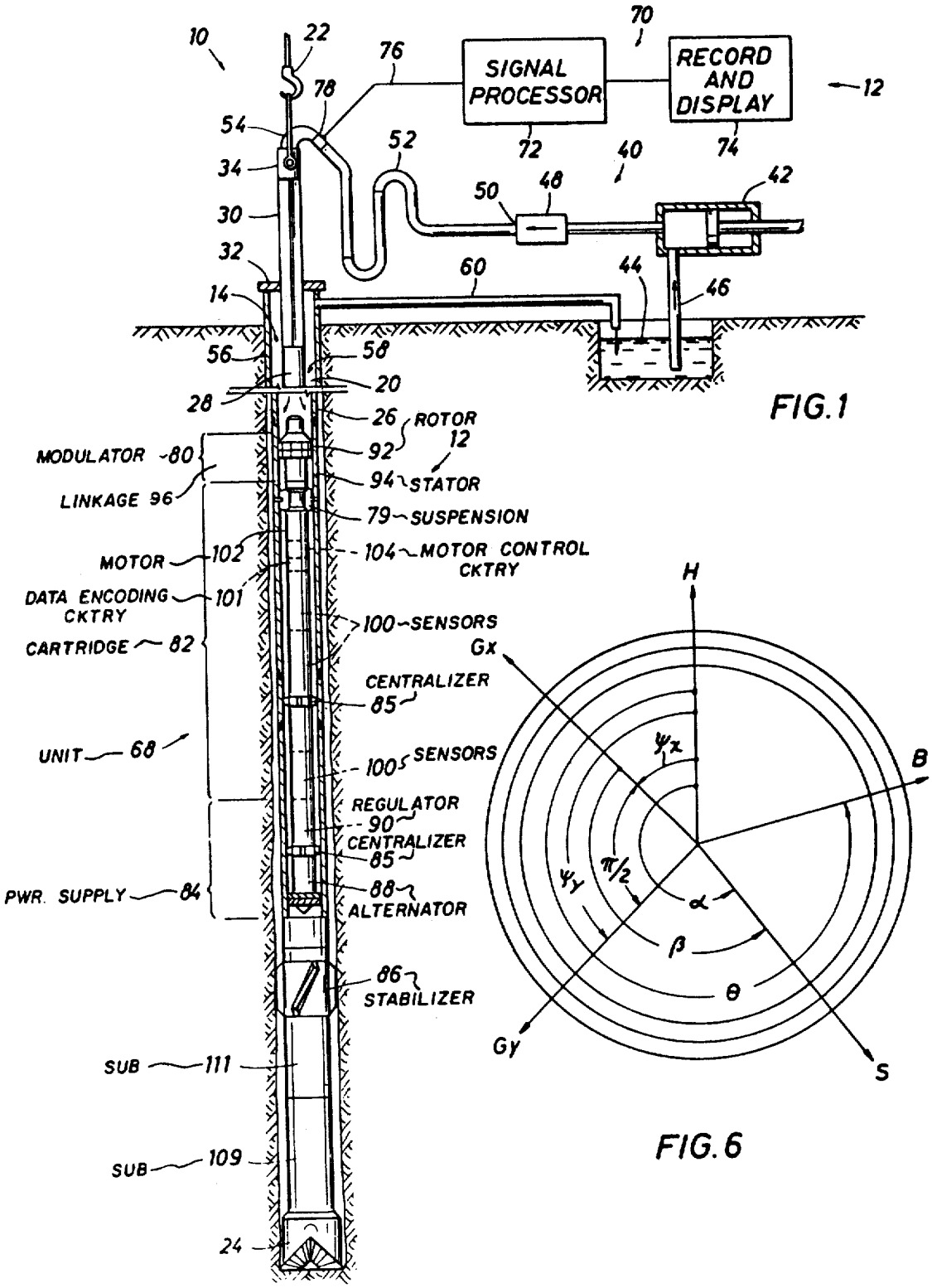
FIG. 1 is a schematic drawing showing a generalized well drilling and data measuring system according to one aspect of the invention.
FIG. 6 is a vector diagram defining various angles associated with the drill string during drilling.

Referring now to the drawings, FIG. 1 shows a well drilling system 10 in association with a measuring and telemetering system 12 embodying the invention. For convenience, FIG. 1 depicts a land-based drilling system, but it is understood that a sea-based system is also contemplated.

The measuring and telemetering system 12 depicted in FIG. 1 is a measuring-while-drilling system of the type described in U.S. Pat. Nos. 4,100,528 and 4,103,281. This type of measuring-while-drilling system is preferred; however, as will be apparent from the following description, other types of telemetry systems may be utilized according to the invention. For example, wireline or conductor-in-the-pipe type systems, mud pressure pulse systems, and systems which modulate signals transmitted along the pipe casing may suitably be employed.

As the drilling system 10 drills a well-defining borehole 14, the system 12 senses downhole conditions within the well and generates an acoustic signal which is modulated according to data generated to represent the downhole conditions. In the preferred and illustrated embodiment, the acoustic signal is imparted to drilling fluid, commonly referred to as drilling mud, in which the signal is communicated to the surface of the borehole 14. At or near the surface of the borehole 14 the acoustic signal is detected and processed to provide recordable data representative of the downhole conditions. This basic system is described in detail in U.S. Pat. No. 3,309,656 to Godbey which is hereby incorporated by reference.

The drilling system 10 is conventional and includes a drill string 20 and a supporting derrick (not shown) represented by a hook 22 which supports the drill string 20 within the borehole 14.

The drill string 20 includes a bit 24, one or more drill collars 26, and a length of drill pipe 28 extending into the hole. The pipe 28 is coupled to a kelly 30 which extends through a rotary drive mechanism 32. For "rotary" drilling, actuation of the rotary drive mechanism 32 (by equipment not shown) rotates the kelly 30 which in turn rotates the drill pipe 28 and the bit 24. For "directional" drilling, kelly 30 is held against rotation and a downhole motor (not shown) is provided to rotate the bit. The kelly 30 is supported by the hook via a swivel 34.

Positioned near the entrance of the borehole 14 is a conventional drilling fluid circulating system 40 which circulates the mud downwardly into the borehole 14. The mud is circulated downwardly through the drill pipe 28 during drilling, exits through jets in the bit 24 into the annulus and returns uphole where it is received by the system 40. The circulating system 40 includes a mud pump 42 coupled to receive the mud from a mud tank 44 via a length of tubing 46. A desurger 48 is coupled to the exit end of the mud pump 42 for removing any surges in the flow of the mud from the pump 42, thereby supplying a substantially continuous flow of mud at its output orifice 50. A mud line 52 couples the output orifice 50 of the desurger to the kelly 30 via a gooseneck 54 coupled to the swivel 34.

Mud returning from downhole exits near the mouth of the borehole 14 from an aperture in a casing 56 which provides a flow passage 58 between the walls of the borehole 14 and the drill pipe 28. A mud return line 60 transfers the returning mud from the aperture in the casing 56 into the mud pit 44 for recirculation.

The system 12 includes a downhole acoustic signal generating unit 68 and an uphole data receiving and decoding system 70. The acoustic signal generating unit 68 senses the downhole conditions and imparts a modulated acoustic signal to the drilling fluid. The acoustic signal is transmitted by the drilling fluid to the uphole receiving and decoding system 70 for processing and display.

To this end, the receiving and decoding system 70 includes a signal processor 72 and a record and display unit 74. The processor 72 is coupled by a line 76 and one or more pressure transducers 78 to the mud lines 52. The modulated acoustic signal transmitted uphole by the drilling fluid is monitored by the transducer 78, which in turn generates electrical signals to the processor 72. These electrical signals are decoded into meaningful information representative of the downhole conditions, and the decoded information is recorded and displayed by the unit 74.

One such uphole data receiving and decoding system 70 is described in U.S. Pat. No. 3,886,495 to Sexton et al., issued May 27, 1975, entitled "Uphole Receiver for Logging-While-Drilling System," which is hereby incorporated by reference.

The downhole acoustic signal generating unit 68 is supported within one or more of the downhole drill collars 26 by a suspension mechanism 79 and generally includes a modulator 80 having at least part of the flow of the mud passing through it. The modulator 80 is controllably driven for selectively modifying the flow of the drilling fluid to thereby impart the acoustic signal to the mud. A cartridge 82 is provided for sensing various downhole conditions and for driving the modulator 80 accordingly. The generating unit 68 also includes a power supply 84 for energizing the cartridge 82. A plurality of centralizers 85 is provided to position the modulator 80, the cartridge 82, and the supply 84 centrally within the collar 26. One or more stabilizers 86 is provided for supporting and stabilizing the drill collars during drilling.

The power supply 84 may be of a design known in the art and includes a turbine positioned within the flow of the drilling fluid to drive the rotor of an alternator 88. A voltage regulator 90 regulates the output voltage of the alternator 88 to a proper value for use by the cartridge 82.

Suitable designs for the modulator 80 are also now known in the art. It includes a movable member in the form of a rotor 92 which is rotatably mounted on a stator 94. At least part of the flow of the mud passes through apertures in the rotor 92 and in the stator 94, and rotation of the rotor selectively modifies flow of the drilling fluid when the apertures are in misalignment, thereby imparting the acoustic signal to the drilling fluid. A motor 102 is coupled to gear reduction drive linkage 96 which drives the rotor. The cartridge 82 is operably connected to the linkage 96 for rotating the rotor 92 at speeds producing an acoustic signal in the drilling fluid having (1) a substantially constant carrier frequency which defines a reference phase value, and (2) a selectively produced phase shift relative to the reference phase value at the carrier frequency. The phase shift is indicative of encoded data values representing the measured downhole conditions.

In the preferred embodiment the drive linkage 96 and the designs of the rotor 92 and stator 94 are chosen to generate five carrier cycles in the acoustic signal for each revolution of the rotor 92.

A suitable modulator 80 is shown and described in detail in U.S. Pat. No. 3,764,970 to Manning which is assigned to the assignee of this invention. Other suitable modulators 80 are described in the above-referenced Patton and Godbey patents, as well as in "Logging-While-Drilling Tool" by Patton et al., U.S. Pat. No. 3,792,429, issued Feb. 12, 1974, and in "Logging-While-Drilling Tool" by Sexton et al., U.S. Pat. No. 3,770,006, issued Nov. 6, 1973, all of which are hereby incorporated by reference.

Referring now to the cartridge 82, it includes one or more sensors 100 and associated data encoding circuitry 101 for measuring the downhole conditions and generating encoded data signals representative thereof. For example, the sensors 100 may be provided for monitoring drilling parameters such as the direction of the hole (azimuth of hole deviation), weight on bit, torque, etc. The sensors 100 may be provided for monitoring safety parameters, such as used for detecting over pressure zones (resistivity measurements) and fluid entry characteristics by measuring the temperature of the drilling mud within the annulus 58. Additionally, radiation sensors may be provided, such as gamma ray sensitive sensors for discriminating between shale and sand and for depth correlation. As will be explained, sensors may also be provided for detecting bending moment applied to a lower portion of the drill string resulting from lateral forces on the drill bit during drilling.

The data encoding circuitry 101 is of the conventional type and includes a multiplex arrangement for encoding the signals from the sensors into binary and then serially transmitting them over a data line. A suitable multiplex encoder arrangement is disclosed in detail in the above referenced Sexton et al. patent, U.S. Pat. No. 3,820,063, which is hereby incorporated by reference. The cartridge 82 also includes motor control circuitry 104 for controlling the speed of the motor 102 for rotating the rotor 92 of the modulator 80 at the proper speeds to effect the desired acoustic signal generation. The motor 102 is a two or three phase AC induction motor which, in the preferred embodiment, is driven at 60 Hz by the motor control circuitry 104. Use of an induction motor for the motor 102 is not critical, as other types of motors could be adopted.

The above measuring-while-drilling system 12 is described in detail U.S. Pat. Nos. 4,100,528, 4,103,281, and 4,167,000 (a continuation of patent application Ser. No. 727,685, now abandoned), all having an effective filing date of Sept. 29, 1976, and assigned to the assignee of the present invention. These patents and the application are expressly incorporated herein by reference for their showing of a detailed implementation of a preferred system 12.

In accordance with the invention, a downhole drilling parameter is measured coherently with the rotation of a lower portion of the drill string. The rotational orientation of the lower portion of the drill string about its axis is monitored downhole as a function of a fixed directional reference, such as gravity or the magnetic field of the earth, and compared with the measured drilling parameter. This comparison relates the measured drilling parameter to the fixed directional reference. The measured parameter and fixed directional reference are either processed downhole and telemetered uphole by the system 12 or processed uphole after telemetry by the system 12. When the measured drilling parameter is the bending moment applied to a lower portion of the drill string, the invention is well-suited for providing information useful in predicting the future course which the borehole will take upon continued drilling.

In more detail, boreholes drilled deeply into the earth are rarely, if ever, straight. Therefore, the drill string 20, even though considered relatively inflexible, undergoes bending. This bending is illustrated in FIG. 3*a* which depicts a five-ten foot pony sub 109 and an approximately four foot bending sub 111 located between the drill bit 24 and the first stabilizer 86. When the drill string is of the type which rotates during drilling, a given point on a section of the drill string to which a bending moment is applied is alternately in compression and tension as the drill string rotates. When the drill string is fixed at its upper end and includes a downhole motor for rotating the drill bit, the lower end of the drill string above the motor will vary in rotational orientation due to the torque of drilling; this likewise causes variation in the compression or tension at a given point on a section of the drill string to which a bending moment is applied. This is illustrated in FIG. 3*b*, wherein the sub 111 is shown in partial cross section as having a tubular outer wall member 111*a* and a strain amplifier section 111*b* expandably secured to the wall 111*a*. The extent of the compression and tension is directly related to the magnitude of the lateral force applied to the drill bit.

The radial force of the rock formation against the bit is illustrated in FIG. 3*a* as a resultant force F, which is inherently applied to the drill bit 24 during the drilling operation. This force results generally from axial forces on the bit, such as weight-on-bit forces, and from transverse forces on the bit due to hydraulic effects, the weight-of-the bit which is assumed to be localized, the distributed weight of the section of the drill string 20 coupled to the drill bit, and the buoyancy force due to displacement of drilling mud.

Since the drill bit tends to follow a course generally tangential to the direction of the resultant force applied to the drill bit 24 during the drilling operation, measurement of the axial forces and of the bending moment at a lower portion of the drill string above the drill bit (which is a function of the transverse resultant force), with respect to magnitude and direction, can be processed to provide an indicator of the course which the drill bit 24 will take during continued drilling.

Figure 4:
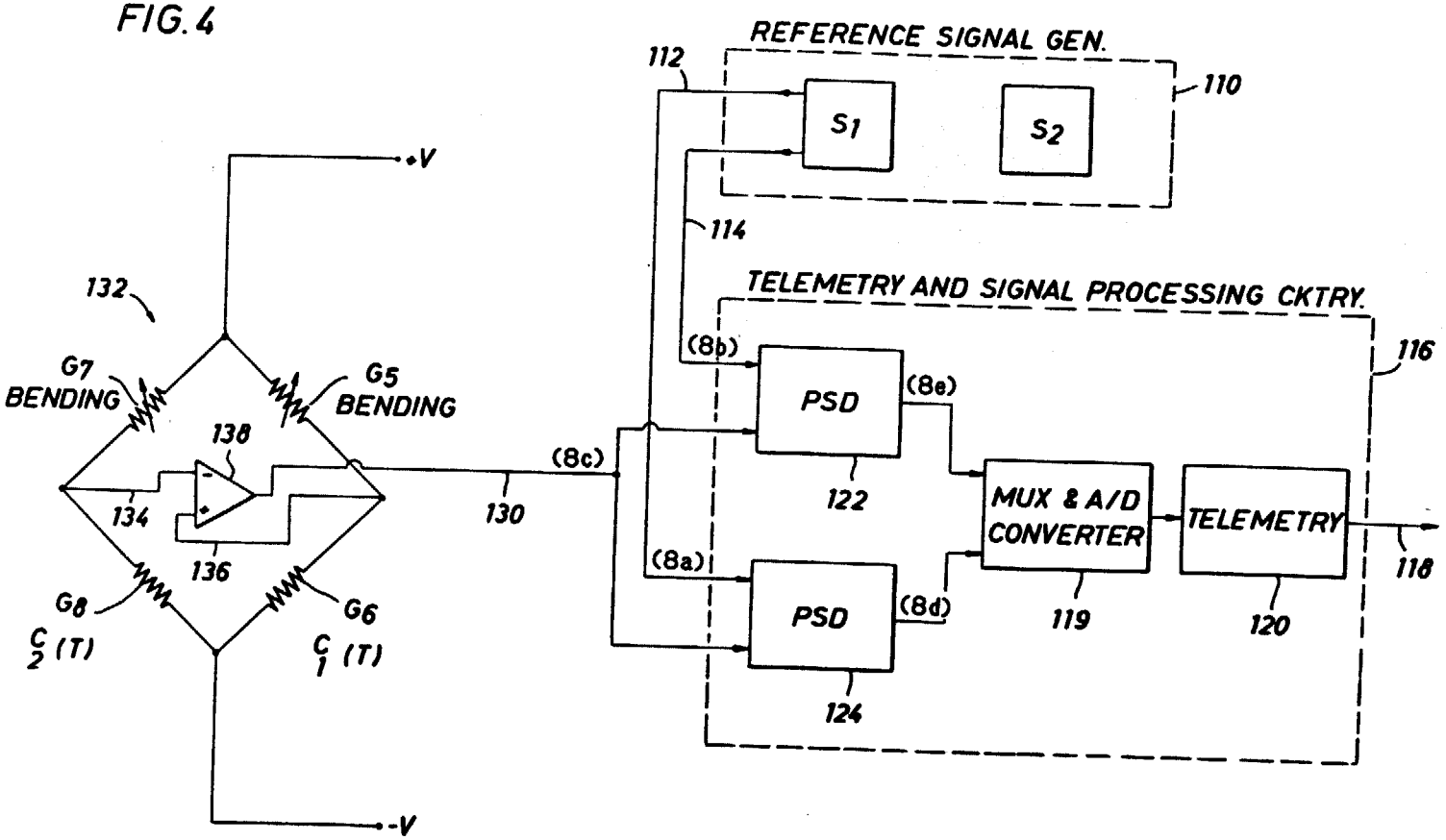
FIGS. 4 and 5*a*–5*c* are schematic diagrams of downhole electrical circuitry utilized according to the invention.

In more detail and referring additionally to FIGS. 2–4, sensors $S_1$ and $S_2$ are provided as a reference signal generator 110 for generating a downhole reference signal (DR signal) which is indicative of the angular relationship between the drill string 20 and a directional reference such as gravity or magnetic north. For purpose of illustration the sensors $S_1$ and $S_2$ are shown positioned at the location between the drill bit 24 and first stabilizer 86. However, they may more conveniently be located in the cartridge 82. The sensors are secured in any suitable manner along radii of the sub 111; preferably the sensors $S_1$ and $S_2$ are located on radii orthogonal to one another in order to simplify the mathematics used for processing the signals, as will be explained.

A directional reference, as opposed to a time reference, is used. Time is not a suitable reference in part because the lower portion of the drill string twists unpredictably during drilling and does not rotate at a constant rate. Detecting the bending moment applied to the lower portion of the drill string coherently with rotational orientation thereof (rather than with respect to time) enables a more accurate determination of the magnitude and direction of lateral force applied to the drill bit.

Figure 7:
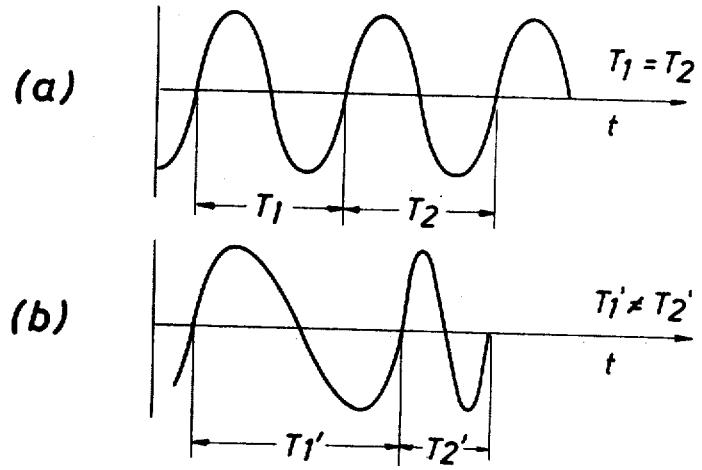
FIGS. 7*a* and 7*b* show the outputs of a directional sensor when drill string rotation is at constant and non-constant angular velocities, respectively.
Figure 8:
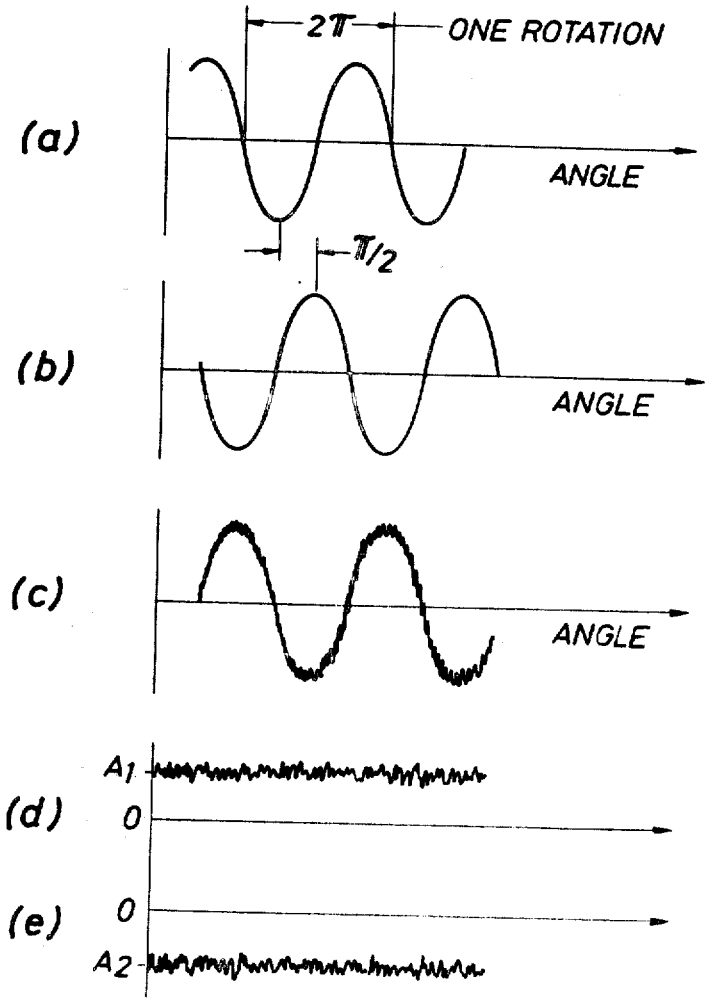
FIGS. 8*a* and 8*b* illustrate directional reference signals on lines 112, 114 of FIG. 4.
FIG. 8*c* illustrates a downhole variable signal on line 130 of FIG. 4.
FIGS. 8*d* and 8*e* illustrate the analog signal components at the outputs of PSD's 124, 122 of FIG. 4.

Attention is directed to FIGS. 7*a* and *b*, and 8*a* and *c*. FIG. 7*a* shows the sinusoidal output waveform which would be produced by a directional sensor (such as $S_1$ or $S_2$) if angular rotation of the sensor were constant with time. FIG. 7*b* represents the distorted time-based wave form from such a sensor in the actual case where angular rotation varies unpredictably with time, as would result for example from the drill bit stopping, skipping and spinning wildly during drilling. FIG. 8*a* illustrates the sensor output as a function of angular rotation, which is independent of time. As will be explained further below, the bending moment applied to a lower portion of the drill string is also detected as a function of angular rotation to produce a signal as represented in FIG. 8*c*. Signals 8*a* and 8*c* are thus phase-coherent and useful in determining magnitude and direction of the bending moment.

In the preferred embodiment, the sensors $S_1$, $S_2$ take the form of magnetometers and the directional reference is the magnetic field of the earth. The sensors $S_1$, $S_2$ may take other forms; for example, if the well is not vertical, accelerometers may be employed, with the directional reference being the gravitational field of the earth. The DR signal takes the form of first and second reference signals (8*a*, 8*b*) respectively generated by the sensors $S_1$, $S_2$ on a pair of lines 112, 114. As is well known in the art, a magnetometer generates a signal having a value proportional to the earth's magnetic field as measured along the axis of the magnetometer. The sensors $S_1$, $S_2$ preferably are positioned on the drill string to generate the reference signals to be indicative of the strength of the magnetic field along orthogonal radii of the drill string, i.e., separated by 90 degrees of rotation.

In an alternative circuit, the reference signal generator 110 may use two axes of a commercially available tri-axial magnetometer rather than a pair of single axis magnetometers as shown in FIG. 2.

According to the preferred embodiment of the invention, the DR reference signals 8*a*, 8*b* on the lines 112, 114 are provided as inputs to telemetry and signal processing circuitry 116. In response to the reference signals and to a downhole variable signal (DV) signal 8*c* which is generated on a line 130, the telemetry and signal processing circuitry 116 generates on a line 118 a processed signal which is representative of the magnitude and direction of bending moments applied to the sub 111. The bending moments are measured using the bit 24 as a reference so that the magnitude of the lateral force F applied to the bit 24 may be represented; it will be understood that the resultant directional bending moment applied to the sub 111 is the product of the resultant lateral force applied to the bit 24 and the effective moment arm.

In the preferred embodiment shown in FIG. 4, the circuitry 116 includes a multiplexor and analog-digital converter section 119 and a telemetry section 120. The sections 119 and 120 are implemented as part of the measuring-while-drilling system 12.

The telemetry and signal processing circuitry 116 also includes a pair of phase sensitive detectors (PSDs) 122, 124 of the conventional type. The PSDs 122, 124 generate analog signals 8*d*, 8*e* respectively having a varying DC level of a value (magnitude) which represents the component of the DV signal on the line 130 which is in-phase with the DR signal on the line 114, 112. A high frequency noise may exist on the DC level such that a filter (not shown) may advantageously be employed to filter or remove the high frequency noise, leaving the analog signal to be transmitted on the line 118.

The phase sensitive detector circuits 124, 122 respectively receive as inputs the DR reference signals 8*a*, 8*b* on the lines 112, 114 and the DV signal 8*c* generated on the line 130. The DV signal is generated to be indicative of the resultant or total bending moment applied to sub 111 to thereby represent the value of the force F applied to the drill bit 24. Accordingly, the varying DC levels output from the PSDs 124, 122 represent the components of the force F in the direction of the axes of the respective magnetometers (or accelerometers) $S_1$, $S_2$.

A strain signal generator 132 is provided for generating the DV signal on the line 130. In the preferred and illustrated embodiment, it includes a Wheatstone bridge arrangement of strain gauges G5–G8 having output lines 134, 136 connected as inputs to a difference amplifier 138. The difference amplifier 138 may be a conventional operational amplifier and has its output connected to the line 130 for generating the DV signal.

The strain gauges G5–G8 are secured to the drill string 20, in the drill sub 111 containing the sensors $S_1$, $S_2$. The gauges are disposed at a location to allow measurement of the bending moment applied to the sub 111, as referenced from the drill bit 24. The gauges are preferably disposed between the bit 24 and the first stabilizer 86, and are applied to the drill string 20 in any of several ways suitable for measuring strain.

The gauges G6, G8 in the lower legs of the Wheatstone bridge also provide temperature compensation. The gauges G5, G7 are positioned along a diameter of, and on opposite sides of, the drill string 20. In the illustrated embodiment, the gauges G5, G7 are disposed in the section 111*b* of the sub 111 which is designed to amplify stress and strain. Such amplifier designs are known in the art. For example, the strain integrally fits inside the wall 111*a* as shown in FIG. 3*b*. Section 116 has relatively thin regions 111*c*, and the strain gauges are secured within the thin regions 111*c*.

Alternatively, a Wheatstone bridge arrangement may be utilized having a single one of the gauges G5 or G7 disposed on the drill string 20 for measuring bending stresses at the respective point of contact.

Figure 5A:
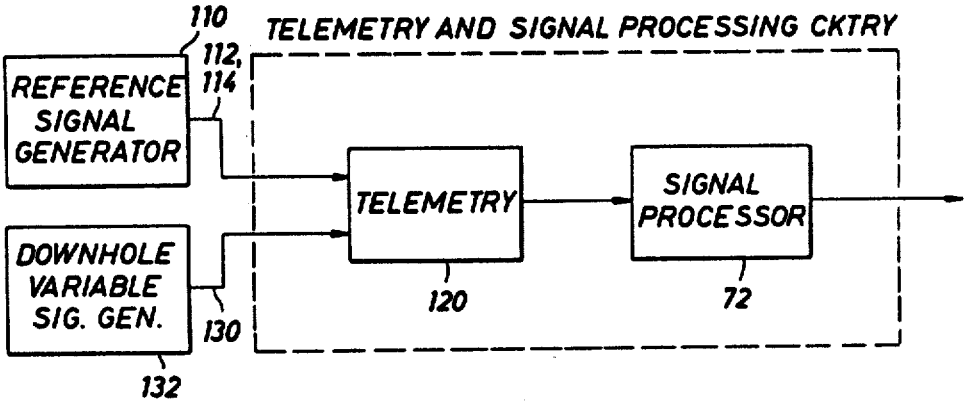
Figure 5B:
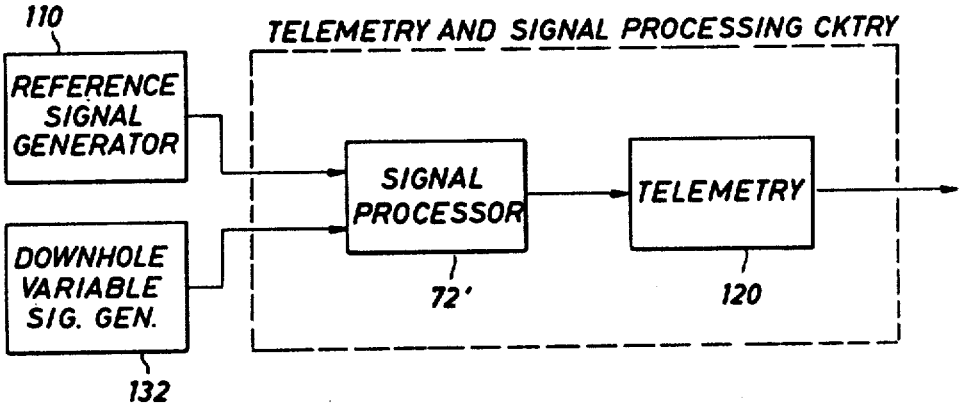
Figure 5C:
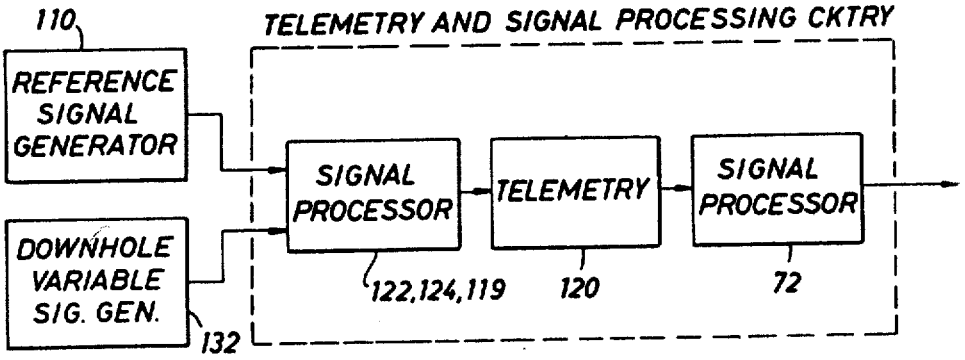

As indicated, FIG. 4 depicts a preferred embodiment utilizing a measuring-while-drilling system of the type described in FIG. 1. In this system, there is some signal processing performed downhole prior to information being telemetered uphole. Once uphole, the information is further processed by the signal processor 72 in a manner to be described subsequently. This general system, employing a rather slow telemetry system and having signal processing both uphole and downhole is shown schematically in FIG. 5*c*. The invention, however, is not limited to such a relatively slow telemetry system and both uphole and downhole signal processing. FIGS. 5*a* and 5*b* depict alternative systems according to the invention. For example, in FIG. 5*a* the DR signal and the DV signal are directly input to the telemetry system 120 for transmission uphole. In this embodiment, essentially all signal processing is performed uphole. Preferably, the telemetry system depicted in FIG. 5*a* would be of the high speed type, such as in the wire line or wire-in-the-pipe type.

In the system of FIG. 5*b*, essentially all of the signal processing is done downhole by circuitry represented by a signal processor 72'. The signal processor 72' would have the data processing capabilities of the signal processors shown in FIG. 5*c*. The telemetry system 120 in FIG. 5*b* could be of either type, but preferably it would be of the rather slow speed type.

The above described arrangement is advantageously utilized when the drill string 20 rotates during drilling. However, the concept of the invention may be modified for use with a drilling rig which drills without rotation of the upper end of the drill string 20, such as when a downhole drilling motor is utilized at the bottom end of the drill string immediately above and for driving the bit 24.

THEORY OF OPERATION

For purpose of description, it will be assumed that the sensors $S_1$, $S_2$ are accelerometers, rather than magnetometers as earlier described. Referring to FIGS. 2–4, the sensors $S_1$, $S_2$ and the strain gauge assemblies G5–G7 disposed on the drill string substantially at the drill bit 24 generate the DR reference signals and the DV signals necessary for the computation of the force vector applied to the drill bit during drilling. Specifically, as the drill string rotates about a curved axis, one can define the plane of the curved axis. When the diameter defined by the assemblies G5, G7 rotates to a position within the plane, the magnitude of the measured bending stress is maximum and is defined by the strength of the measured forces of compression and tension. When the diameter defined by G5, G7 rotate to a position orthogonal to the plane, there are no measured forces of compression and tension.

The detected forces of compression and tension sensed by the gauges G5, G7, according to the Wheatstone bridge arrangement shown in FIG. 4, both contribute to the difference signal applied to the amplifier 138. This signal is applied to the phase sensitive detectors 122, 124. The phase detectors 122, 124 provide an indication of the magnitude of the resultant force in association with the DR reference signal; i.e., the component of the force F in phase with a reference coordinate such as gravity (or the earth's magnetic field). The outputs from the PSD's 122, 124 are transmitted for processing.

The processing which is necessary to derive the magnitude and direction of the resultant force F is apparent from the diagram of FIG. 6. FIG. 6 is a diagram relating the X-component $G_x$ and the Y-component $G_y$ of the accelerometer, the measured strain signal S, and the bending moment B to the direction H of the high side of the hole. It is to be understood that the coordinate system described in FIG. 6 is preferred; however, other coordinate systems may be selected in accordance with the invention.

The $G_x$ and $G_y$ components are the results of readings about orthogonal radii of the drill string. The angle between the high side H of the hole and the $G_x$ vector is defined as $\psi_x$ (psi$_x$). The angle between the direction H of the high side of the hole and the $G_y$ component of the accelerometer measurement is defined as $\psi_y$ (psi$_y$). The angle between the direction of the unknown bending moment B and the direction H of high side of the hole is defined as the angle $\theta$ (theta). The angle between the $G_x$ component and the directon of the force signal S is defined as the angle $\beta$ (beta). The angle between the direction H of the high side of the hole and the direction of the force signal S is defined as the angle $\alpha$ (alpha). As already indicated, the $G_x$ and $G_y$ components of the direction signal are at 90 degrees.

For a rotating drill string, wherein the force signal produces a vector S which varies over time, and wherein the direction signals from the accelerometer produce $G_x$ and $G_y$ vectors which vary over time, the angles $\psi_x$ and $\psi_y$ and $\alpha$ also vary over time. Due to drilling characteristics, the direction of the bending moment B may be considered to change more slowly with respect to time. Thus, the angle $\theta$ may be considered constant for a given set of measurements.

Assuming that the angle between the normal to the plane defined by the $G_x$ and $G_y$ vectors and vertical is the angle $\phi$ (phi), it may be shown that the following relationships obtain:

$$G_x = G \sin \phi \cos \psi_x \quad \text{EQN. 1}$$

$$G_y = G \sin \phi \cos \psi_x \quad \text{EQN. 2}$$

$$S = B \cos (\theta - \alpha) \quad \text{EQN. 3}$$

$$\psi_x = \psi_{xo} + \omega t \quad \text{EQN. 4}$$

$$\psi_y = \psi_{yo} + \omega t \quad \text{EQN. 5}$$

$$\alpha = \alpha_o + \omega t \quad \text{EQN. 6}$$

where G is the magnitude of the gravitational force of the earth and the zero-subscripted terms are values at an arbitrary initial time reference.

Operation of the pair of phase sensitive detectors 122, 124 produces the direction signals, which are defined here as $S.G_x$, $S.G_y$ to indicate the operation of the respective PSDs. By recognizing that $\alpha - \psi_x = \beta$ which is a fixed angle known by measurement prior to putting the system into the borehole, and by applying conventional mathematical relationships, it can be shown that $$\tan^{-1} \frac{S \cdot G_y}{S \cdot G_x} = \beta + \theta \quad \text{EQN. 7}$$

Since $\beta$ is known, then the sought-after value of the angle $\theta$ is immediately obtained; i.e., the direction of the bending moment referenced to the drill bit 24 is obtained.

It can also be shown that the magnitude of the bending moment B is defined by the equation $$B = [(S.G_x)^2 + (S.G_y)^2]^{\frac{1}{2}} \quad \text{EQN. 8}$$

It will be appreciated that, since there is no direct way to measure an angle of rotation of the drill string 20 without an inertial device, the direction of the bending moment B is obtained in the preferred embodiment by comparing the time elapsed between the observation of magnetic north and the observation of the maximum value of the force signal to the total time between two successive observations of magnetic north. Because the rotation of the drilling string does not necessarily proceed at a perfectly constant rate, a time averaging of the measurements may be required.

Thus, if the location of the drill bit is known from other measurements, such as measurements taken using measuring-while-drilling techniques, the anticipated drilling direction vis-a-vis the already drilled borehole may be obtained by utilizing the above determined values.

Although the invention has been described in its preferred form with a certain degree of particularity, it is understood that the present disclosure has been made by way of example only. Numerous changes in the details and construction of the combination and arrangement of components will be apparent without departing from the spirit and the scope of the invention.

What is claimed is:

1. A system operable during the drilling of a borehole for producing a signal useful in predicting the path which the drill bit of a drill string will take during continued drilling, at least a lower portion of the drill string varying in rotational orientation about its axis during drilling, comprising:

a. means coupled downhole to said drill string for generating at least one reference signal representing rotational orientation of said lower portion of the drill string relative to a predetermined direction;

b. means coupled downhole to said drill string for generating a strain signal representing bending moments applied to said lower portion of the drill string, said strain signal being coherent with respect to the varying rotational orientation of said lower portion of the drill string; and c. means for phase-correlating said reference signals with said strain signal to generate an output signal representing the magnitude and direction of said applied bending moments.

2. The system according claim 1, wherein said reference signal generating means comprises first and second transducers for generating respective first and second reference signals whose magnitudes represent components of a vector defining said rotational orientation.

3. The system of claim 1, wherein said phase-correlating means comprises phase detector means for generating a first processed signal having a magnitude proportional to the component of said strain signal which is in rotational phase coherence with said first reference signal and a second processed signal having a magnitude proportional to the component of said strain signal which is in rotational phase coherence with said second reference signal, and for generating said output signal from said first and second processed signals.

4. A system operable during the drilling of a borehole for generating a direction signal indicative of the direction which the drill bit of a drill string will take during continued drilling, at least a lower portion of the drill string undergoing rotational motion during drilling of the borehole, comprising:

a. a reference signal generator coupled to said lower portion of the drill string for generating during the drilling a reference signal indicative of the rotational orientation of said lower portion of the drill string about its axis with respect to a directional reference;

b. a strain signal generator coupled to said lower portion of the drill string for generating, during drilling and as a function of the rotational orientation of said lower portion of the drill string, a strain signal representing a bending moment applied to said lower portion of the drill string resulting from lateral forces applied to said drill bit; and c. telemetering and processing circuitry responsive to said strain signal and said reference signal for generating said direction signal to represent the rotational phase coherence between said strain and reference signals, thereby to represent the direction of the resultant of said lateral forces as a function of said directional reference.

5. The system according to claim 4, wherein said strain signal represents the direction relative to the drill string and the magnitude of the bending moment applied to said lower portion of the drill string, and wherein said direction signal generated by said telemetering and processing activity further indicates the magnitude of said resultant of the lateral forces.

6. The system according to claim 4, wherein said drill string is fixed against rotation at its upper end and includes a downhole drilling motor coupled in said lower portion of the drill string above said drill bit, and wherein said reference signal is indicative of the varying rotational orientation of said lower portion of the drill string about its axis with respect to said direction reference, said varying rotational orientation induced by torque during drilling.

7. The system according to claim 4, wherein said reference signal generator comprises first and second magnetometers, said directional reference being the magnetic field of the earth.

8. The system according to claim 7, wherein said magnetometers are secured to the drill string at radii which are orthogonal to one another.

9. The system according to claim 4, wherein said reference signal generator comprises a pair of accelerometers, said directional reference being the direction of gravity.

10. The system according to claim 9, wherein said accelerometers are secured to the drill string so as to detect mutually orthogonal components of gravitational force.

11. The system according to claim 4, wherein said telemetering and processing circuitry includes first and second phase-sensitive detectors coupled to receive said strain signal and to receive said reference signal for generating a processed signal indicative of the direction of the resultant of said lateral forces relative to said directional reference, and indicative of the magnitude of the resultant of said lateral forces.

12. The system according to claim 4, wherein said strain signal generator comprises a bending sub coupled in said lower portion of the drill string, said bending sub having strain gauges mounted thereon for generating said strain signal.

13. The system according to claim 12, wherein said bending sub comprises a tubular outer wall member and a strain amplifier section secured within said outer wall member, said strain gauges being mounted on said strain amplifier section for generating said strain signal in response to bending moments applied to said bending sub.

14. The system according to claim 13, wherein said strain amplifier section comprises a tubular member having relatively thin-walled regions to which said strain gauges are secured.

15. The system according to claim 12, wherein said strain gauges are mounted at diametrically opposed regions of said strain sub.

16. A method for monitoring the operational characteristics of a drill string during drilling for enabling determination of the future course which the drill bit will take, comprising the steps of:

a. generating downhole during drilling a reference signal indicative of the varying rotational orientation of a lower portion of the drill string about its axis with respect to a directional reference;

b. generating downhole during drilling a downhole variable signal representing a resultant bending moment applied to a lower portion of the drill string, said signal varying as a function of the varying rotational orientation of said lower portion of the drill string; and c. in response to said reference signal and to said downhole variable signal, generating a processed signal representative of the rotational phase coherence between said reference signal and said downhole variable signal, thereby representing the direction of said resultant bending moment with respect to the directional reference and enabling determination of the future course which the bit will take.

17. The method according to claim 16, further including the step of telemetering the processed signal to an uphole location for display.

18. The method according to claim 16, wherein said step of generating said downhole variable signal comprises the step of detecting strain on said lower portion of the drill string at a location relatively near said drill bit.

19. The method according to claim 16, wherein said step of generating said variable signal comprises the step of detecting strain at diametrically opposed locations on said lower portion of the drill string 20. During the drilling of a borehole using a drill string and a rotating drill bit, a method for aiding prediction of the direction which the borehole will be drilled during continued drilling, comprising the steps of:

a. during rotation of the drill bit, generating downhole first and second reference signals indicative of the varying angular relationship between a lower portion of the drill string and a directional reference;

b. during rotation of the drill bit, generating downhole a strain signal indicative of the varying bending moment applied to said lower portion of the drill string resulting from lateral forces applied to the drill bit;

c. in response to said reference signals and to said strain signal, generating a first processed signal having a magnitude representing the component of the strain signal in rotational phase coherence with said first reference signal, and generating a second processed signal representing the component of the strain signal in rotational phase coherence with said second reference signal; and d. in response to said first and second processed signals, generating a third processed signal indicative of the direction and magnitude of said bending moment.

21. The method according to claim 20, wherein said steps a.–d. are performed downhole, further comprising the step of transmitting said third processed signal uphole for display.

22. The method according to claim 20, wherein the step of generating said strain signal comprises detecting strain on at least one location of the lower portion of the drill string relatively near the drill bit.

23. The method according to claim 22 wherein the step of generating said strain signal comprises detecting strain on at least two diametrically opposed locations of the lower portion of the drill string relatively near the drill bit.

* * * * *